US007278559B1

(12) United States Patent
Sutton et al.

(10) Patent No.: US 7,278,559 B1
(45) Date of Patent: Oct. 9, 2007

(54) GARMENT HANGER WITH REMOVABLE SIDE INDICATOR

(75) Inventors: Steven Sutton, Brooklyn, NY (US); John G. Warmath, Humbolt, TN (US)

(73) Assignee: The Accessory Corp., New York, NY (US)

( * ) Notice: Subject to any disclaimer, the term of this patent is extended or adjusted under 35 U.S.C. 154(b) by 238 days.

(21) Appl. No.: 11/191,298

(22) Filed: Jul. 28, 2005

Related U.S. Application Data

(63) Continuation-in-part of application No. 11/069,346, filed on Mar. 1, 2005.

(51) Int. Cl.
*A41D 27/22* (2006.01)

(52) U.S. Cl. ..... 223/85

(58) Field of Classification Search ..... 223/85–98
See application file for complete search history.

(56) References Cited

U.S. PATENT DOCUMENTS

| | | | |
|---|---|---|---|
| 4,006,547 | A | 2/1977 | Samuels et al. |
| 4,322,902 | A | 4/1982 | Lenthall |
| 4,333,590 | A | 6/1982 | Princiotta |
| 4,754,643 | A | 7/1988 | Weeks, Jr. et al. |
| 5,096,101 | A | 3/1992 | Norman et al. |
| 5,238,159 | A | 8/1993 | Zuckerman |
| 5,272,806 | A | 12/1993 | Marshall et al. |
| 5,305,933 | A | 4/1994 | Zuckerman |
| 5,377,884 | A | 1/1995 | Zuckerman |
| 5,383,583 | A | 1/1995 | Zuckerman |
| 5,388,354 | A | 2/1995 | Marshall et al. |
| 5,407,109 | A | 4/1995 | Zuckerman |
| 5,417,352 | A | 5/1995 | Jen |
| 5,441,182 | A | 8/1995 | Sullivan |
| 5,449,099 | A | 9/1995 | Blanchard |
| 5,469,995 | A | 11/1995 | Bredeweg et al. |
| 5,477,995 | A | 12/1995 | Dooley et al. |
| 5,485,943 | A | 1/1996 | Zuckerman |
| 5,503,310 | A | 4/1996 | Zuckerman et al. |
| 5,507,086 | A | 4/1996 | Marshall et al. |
| 5,524,801 | A | 6/1996 | Dooley et al. |
| 5,586,697 | A | 12/1996 | Johansson |
| 5,590,822 | A | 1/1997 | Zuckerman |
| 5,597,100 | A | 1/1997 | Blitz |
| 5,603,437 | A | 2/1997 | Zuckerman |
| 5,611,469 | A | 3/1997 | Eiley et al. |
| 5,628,132 | A | 5/1997 | Marshall et al. |
| 5,641,100 | A | 6/1997 | Mitchell et al. |
| 5,642,840 | A | 7/1997 | Abdi |
| 5,649,651 | A | 7/1997 | Lam |
| 5,687,887 | A | 11/1997 | Bond et al. |
| 5,819,995 | A | 10/1998 | Zuckerman |

(Continued)

*Primary Examiner*—Shaun R. Hurley
(74) *Attorney, Agent, or Firm*—Gordon & Jacobson, PC

(57) ABSTRACT

A hanger according to the invention includes a cross member with a centrally located hook. A web is formed between the hook and the cross member and is adapted to receive a conventional indicator. The web includes a rib, followed by a valley, followed by a ramp, followed by a plateau. According to the invention, the rib is beveled at the one end and a notch is provided in the web adjacent the beveled end of the rib, the notch extending from the rib to the ramp or to the plateau. The indicator is easily removed from the rib by pressing it into the notch, then sliding it off the web.

19 Claims, 8 Drawing Sheets

U.S. PATENT DOCUMENTS 5,944,237 A 8/1999 Gouldson
6,019,260 A 2/2000 Gouldson
6,041,983 A 3/2000 Sullivan et al.
6,041,984 A 3/2000 Gouldson
6,145,713 A 11/2000 Zuckerman
6,189,746 B1 2/2001 Gouldson
6,260,745 B1 7/2001 Gouldson et al.
6,264,075 B1 7/2001 Gouldson et al.
6,378,744 B2 4/2002 Olk et al.
6,382,478 B2 5/2002 Gouldson et al.
6,422,437 B2 7/2002 Gouldson et al.
6,499,633 B1 12/2002 Pogmore
6,499,634 B2 12/2002 Olk et al.
6,564,980 B2 5/2003 Gouldson et al.
6,865,832 B1 3/2005 Goldman
6,874,666 B2 4/2005 Gouldson et al.

GARMENT HANGER WITH REMOVABLE SIDE INDICATOR

This application is a continuation-in-part of Ser. No. 11/069,346 filed Mar. 1, 2005, the disclosure of which is hereby incorporated herein by reference in its entirety.

BACKGROUND OF THE INVENTION

1. Field of the Invention

This invention relates broadly to garment hangers. More particularly, this invention relates to a garment hanger having a removable side size indicator.

2. State of the Art

For purposes of displaying garments suspended on hangers in an orderly manner to the retail customer, certain retail stores desire to affix an indicating means on the side of the hook of the hanger where the hook meets the hanger body. The indicating means identifies some attribute of the garment suspended from the hanger, such as size, quality, color, manufacturing data, or pattern.

To accommodate the various types of hangers available in the industry, numerous indicating means have been developed in a variety of shapes, sizes and materials. Similarly, hangers have been developed to accommodate a variety of different indicating means. Generally, the indicating means is attached to the hanger at the time that the clothing is attached to the hanger. In many cases, once the indicating means is attached to the hanger, it is difficult or impossible to remove without destroying it and damaging the hanger. This may or may not be a disadvantage. In situations where the purchaser takes the clothing with the hanger, e.g. where the hanger may be used by the purchaser to hang the clothes in the purchaser's wardrobe, this does not generally present a problem. Some clothing which is displayed on hangers at the store is not kept on hangers once purchased. These items of clothing include underwear and swimwear. Typically, the cashier will detach the clothing from the hanger and discard the hanger before packaging the clothing for the purchaser. In many instances, these items of clothing are attached to the hangers at their place of manufacture and then shipped to retailers in the U.S. In most cases, the cost of returning used hangers to the manufacturer outweighs the cost of new hangers. In cases where it is less expensive to recycle the hangers than to buy new hangers, the cost of sorting the hangers according to their indicator makes this practice uneconomical. If, however, the indicating means could be easily removed and replaced without damaging the hanger, then recycling of hangers would be economical.

U.S. Pat. No. 6,189,746 discloses a molded plastic garment hanger having a hook with a web adjacent the hook and a hanger body, wherein the web is received within a cavity of a molded plastic indicator having side walls. The web is formed with a detachment opening which extends under the indicator to allow the indicator to be removed when a detachment wedge is inserted in the opening. While this hanger arrangement is effective, it has the disadvantage of requiring a tool to remove the indicator. It is also dangerous in that when the tool is applied to remove the indicator, the indicator is allowed to fly off the hanger in an unpredictable direction. This projectile can strike someone in the face or eye and cause serious injury.

The previously incorporated parent application discloses a hanger which includes a cross member with a centrally located hook. A web is formed between the hook and the cross member and is adapted to receive an indicator such as the indicator disclosed in the previously mentioned U.S. Pat. No. 6,189,746, the complete disclosure of which is incorporated by reference herein. The web includes (on each side) a rib, followed by a valley, followed by a plateau. According to the parent application, the rib is beveled at the top, has a thick base, and a relatively small notch is provided in the web adjacent the top of the rib. A gradual rise or ramp is located between the valley and the plateau. The indicator is generally U-shaped with inwardly turned ends and a pair of interior fingers. The indicator is easily attached by sliding it over the beveled top of the rib and then down to the thick base of the rib. When attached to the web, the internal fingers of the indicator embrace the rib and the inwardly turned ends lie adjacent the ramp on each side of the web. The indicator is easily and safely removed from the top of the rib by inserting a fingernail or instrument into the notch and leveraging the top of the indicator. In an alternate embodiment, the rib is beveled at the bottom and a notch is provided in the web adjacent the bottom of the rib.

While the parent application discloses arrangements which are improvements in the art, it would be desirable to provide a system which does not require the use of a fingernail or instrument to remove the indicator.

SUMMARY OF THE INVENTION

It is therefore an object of the invention to provide a garment hanger with a removable indicator.

It is another object of the invention to provide a garment hanger with an indicator which can be removed without requiring a tool.

It is a further object of the invention to provide a safe means for removing the indicator which does not result in the indicator becoming a projectile.

It is an additional object of the invention to provide a method for removing the indicator which does not require the use of a fingernail or instrument.

In accord with these objects, which will be discussed in detail below, a hanger according to the invention includes a cross member with a centrally located hook. A web is formed between the hook and the cross member and is adapted to receive an indicator such as the indicator disclosed in the previously mentioned U.S. Pat. No. 6,189,746. The web includes (on each side) a rib, followed by a valley, followed by a plateau. According to the invention, the rib is beveled at the top, has a thick base, and a relatively large notch is provided in the web adjacent the top of the rib. A gradual rise or ramp is located between the valley and the plateau and the notch extends through the valley to the ramp. The indicator is generally U-shaped with inwardly turned ends and a pair of interior fingers. The indicator is easily attached by sliding it over the beveled top of the rib and then down to the thick base of the rib. When attached to the web, the internal fingers of the indicator embrace the rib and the inwardly turned ends lie adjacent the ramp on each side of the web. The indicator is easily and safely removed by pressing the top of the indicator into the notch. This causes the bottom of the indicator to swing out to a point where it can be easily and safely pulled off the web.

Additional objects and advantages of the invention will become apparent to those skilled in the art upon reference to the detailed description taken in conjunction with the provided figures.

BRIEF DESCRIPTION OF THE DRAWINGS

FIG. 4 is an enlarged view of the web looking edge on;

DETAILED DESCRIPTION OF THE PREFERRED EMBODIMENTS

Figure 1:
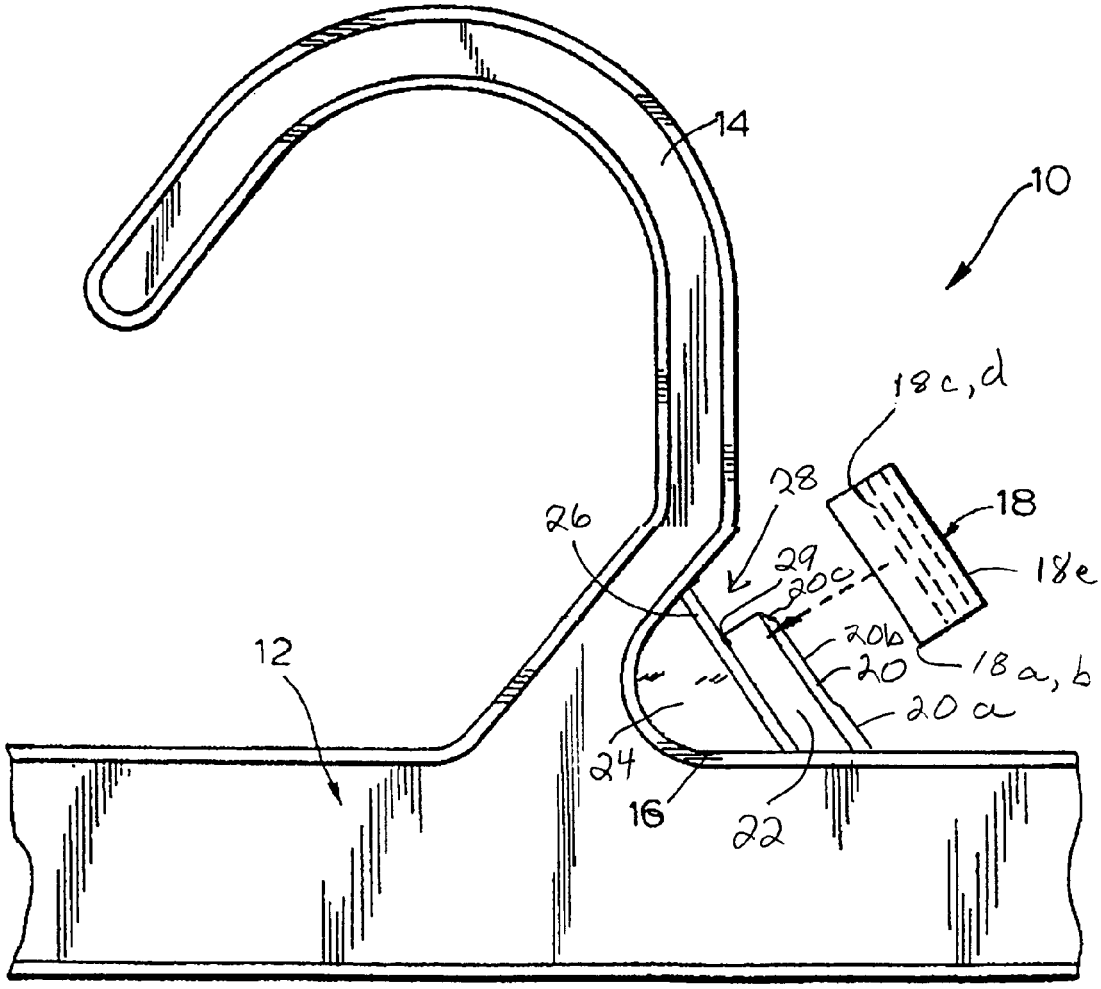
FIG. 1 is a broken side elevation view illustrating a hanger according to the invention and a conventional indicator.

Turning now to FIG. 1, a hanger 10 includes a cross member 12 and a centrally located hook 14. Although the ends of the cross member 12 are not illustrated, those skilled in the art will appreciate that the ends may be provided with clamps or other means for grasping or engaging a garment. They also may be downwardly sloped for supporting blouse, jacket, or the like. A web 16 is formed between cross member 12 and the hook 14 and is adapted to receive an indicator 18. More particularly, the web 16 defines (on each side thereof) a rib 20 followed by a valley 22 followed by a plateau 24. A ramp 26 is provided between the valley 22 and the plateau 24. A notch 28 is provided above the rib 20, i.e. between the rib 20 and the hook 14. According to the invention, the notch 28 preferably extends to the ramp 26 or to the plateau 24 and is preferably formed with a substantially right angle 29 between the valley 22 and the ramp 26.

Figure 4:
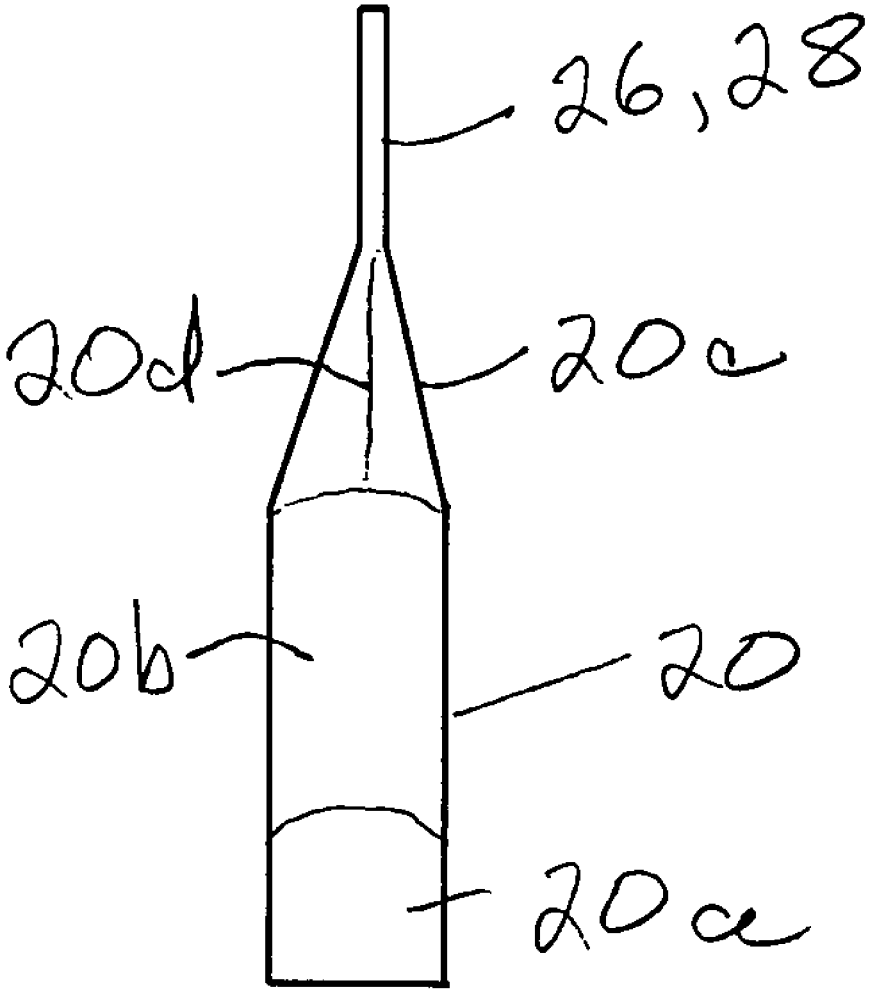

Referring now to both FIGS. 1 and 4, the rib 20 has three portions: a thick base 20*a*, a thinner middle portion 20*b*, and a thinner beveled top 20*c*. It should also be noted that the beveled top 20*c* preferably tapers in two dimensions, i.e. in width as seen best in FIG. 4 in depth as seen best in FIG. 1. The sides of beveled top 20*c* are also preferably sloped on each side to a middle ridge 20*d* as seen in FIG. 4.

Figure 1A:
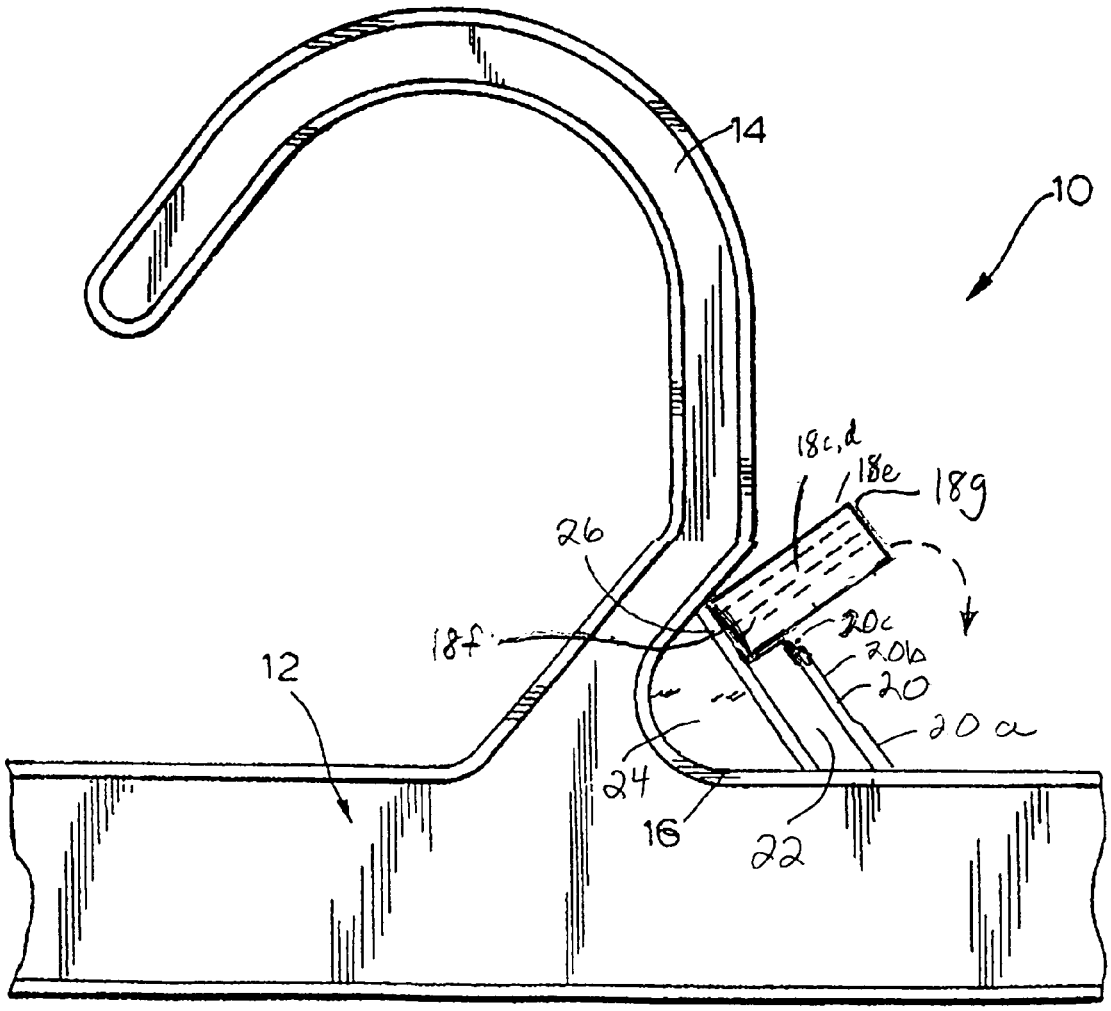
FIG. 1A is a broken side elevation view illustrating one method of attaching the indicator to the web of the hanger.
Figure 2:
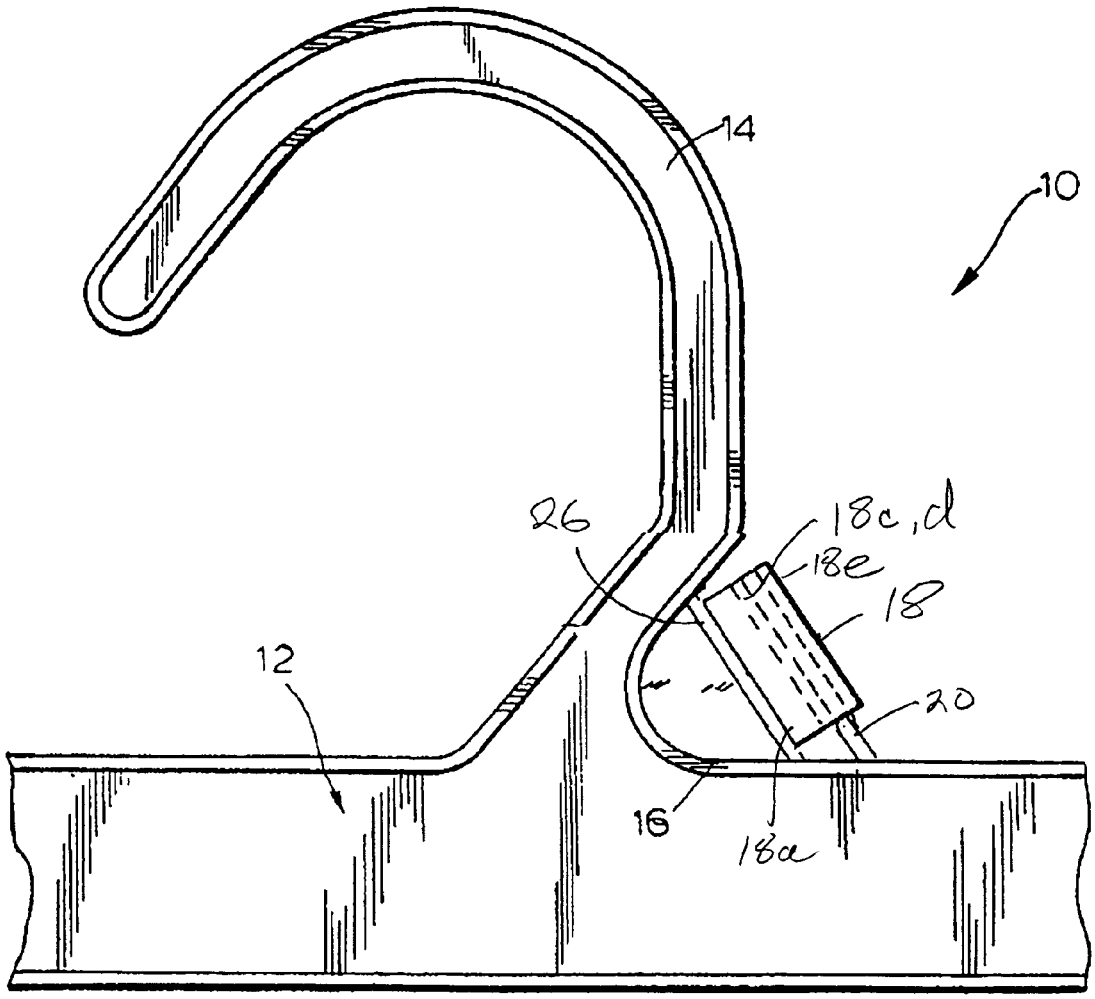
FIG. 2 is a broken side elevation view illustrating a hanger according to the invention with a conventional indicator attached to it.
Figure 5:
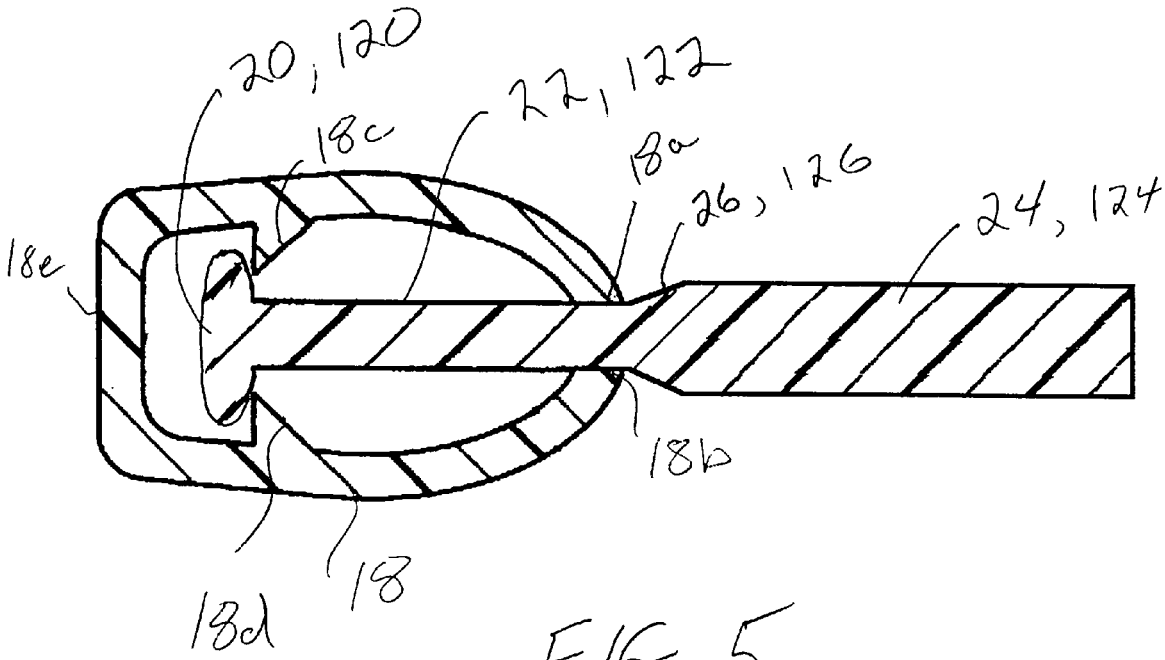
FIG. 5 is a sectional view of a portion of the hanger with the indicator attached.

As mentioned above, the indicator 18 is conventional. It is generally U-shaped with side walls terminating in inwardly turned legs 18*a*, 18*b* defining an opening between them, and with a pair of inwardly extending fingers 18*c*, 18*d*. The indicator also has a closed top 18*e*. The indicator 18 can be snapped directly over the rib 20 by moving the indicator in the direction of the arrow shown in FIG. 1 to assume the position shown in FIGS. 2 and 5. More preferably however, and as shown in FIG. 1A, the indicator can be snapped onto the web by aligning the indicator such that it is generally perpendicular to the web with the closed top 18*e* located away from the rib 20, moving the indicator into the notch 28 so that the front edges 18*f* of the legs abut the ramp 26 (or plateau 24), and rotating the indicator clockwise as shown by the arrow in FIG. 1A until the indicator snaps into place. The rotation of the indicator causes the inwardly turned legs 18*a*, 18*b* to engage and ride over the beveled top 20*c* and thinner middle portion 20*b* of the rib 20 (as well as the ramp 26 and plateau 24—see intermediate position of FIG. 3 which is discussed below with respect to removal) in order to spread the legs and permit the inwardly extending fingers 18*c*, 18*d* to move past the rib and into the valley 22. Once the fingers move completely past the rib (e.g., at a rotation of almost 90 degrees), they snap into place in the valley 22 such that the rib 20 prevents easy removal of the indicator.

Figure 3:
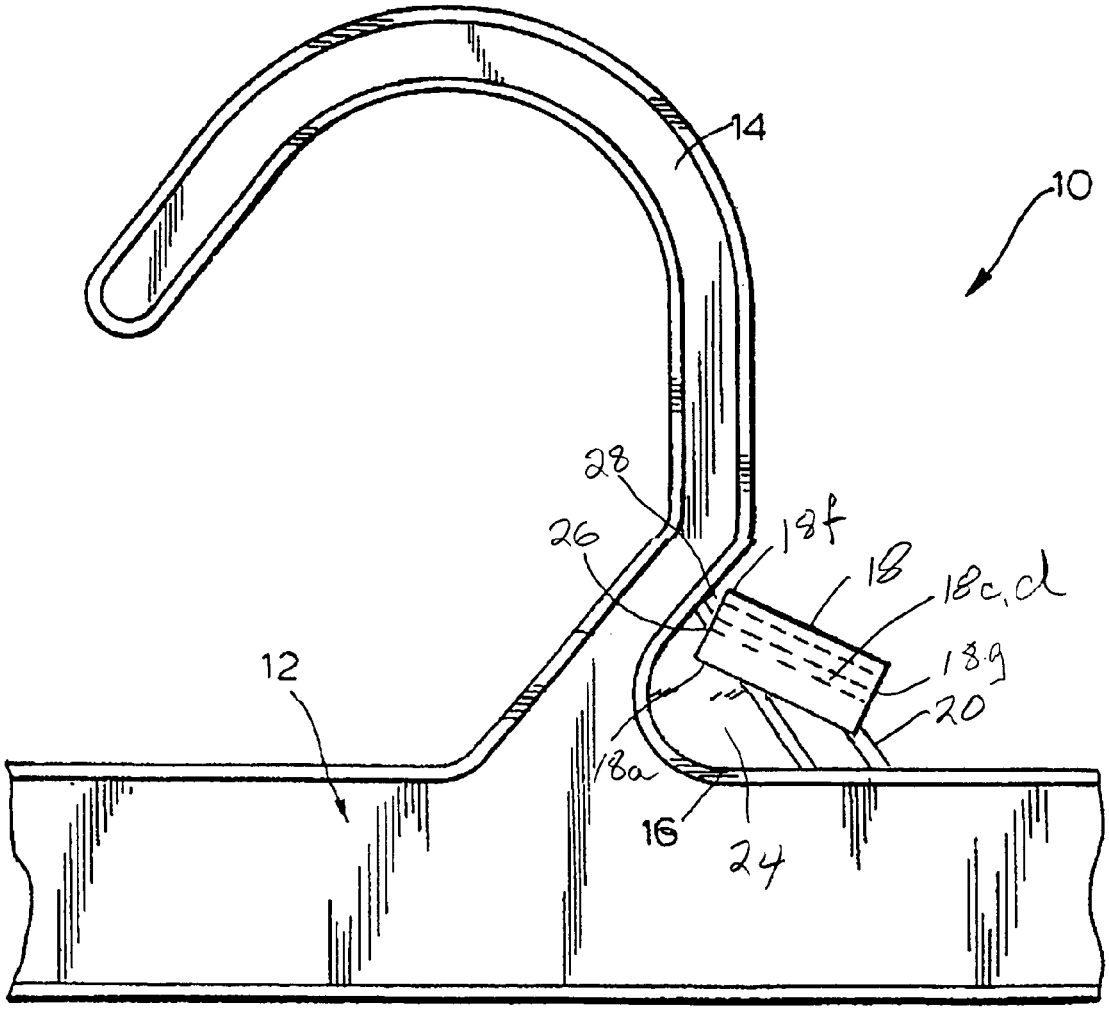
FIG. 3 is a broken side elevation view illustrating a hanger according to the invention with a conventional indicator in a partially removed position.

The indicator 18 can be removed safely from the web 16 by pressing one end 18*f* of the indicator so that it moves into the notch 28 as shown in FIG. 3. The beveled top 20*c* of the rib 20 allows the fingers 18*c*, 18*d* at end 18*f* of the indicator to move over the top portion 20*c* of the rib 20. In turn, this causes the legs 18*a*, 18*b* to move over the ramps 26, spreading the legs apart slightly. This allows the fingers 18*c*, 18*d* to move over the rib 20 and the other end 18*g* of the indicator to extend away from the rib 20. This results in the inwardly turned legs 18*a*, 18*b* lying at one end 18*f* over the plateau 24 and at the other end 18*g* lying over the rib 20, the inwardly extending fingers 18*c*, 18*d* no longer embracing the rib 20. When in this position, shown in FIG. 3, the indicator can be simply grasped and easily linearly slid or rotated off the web 16.

Figure 6:
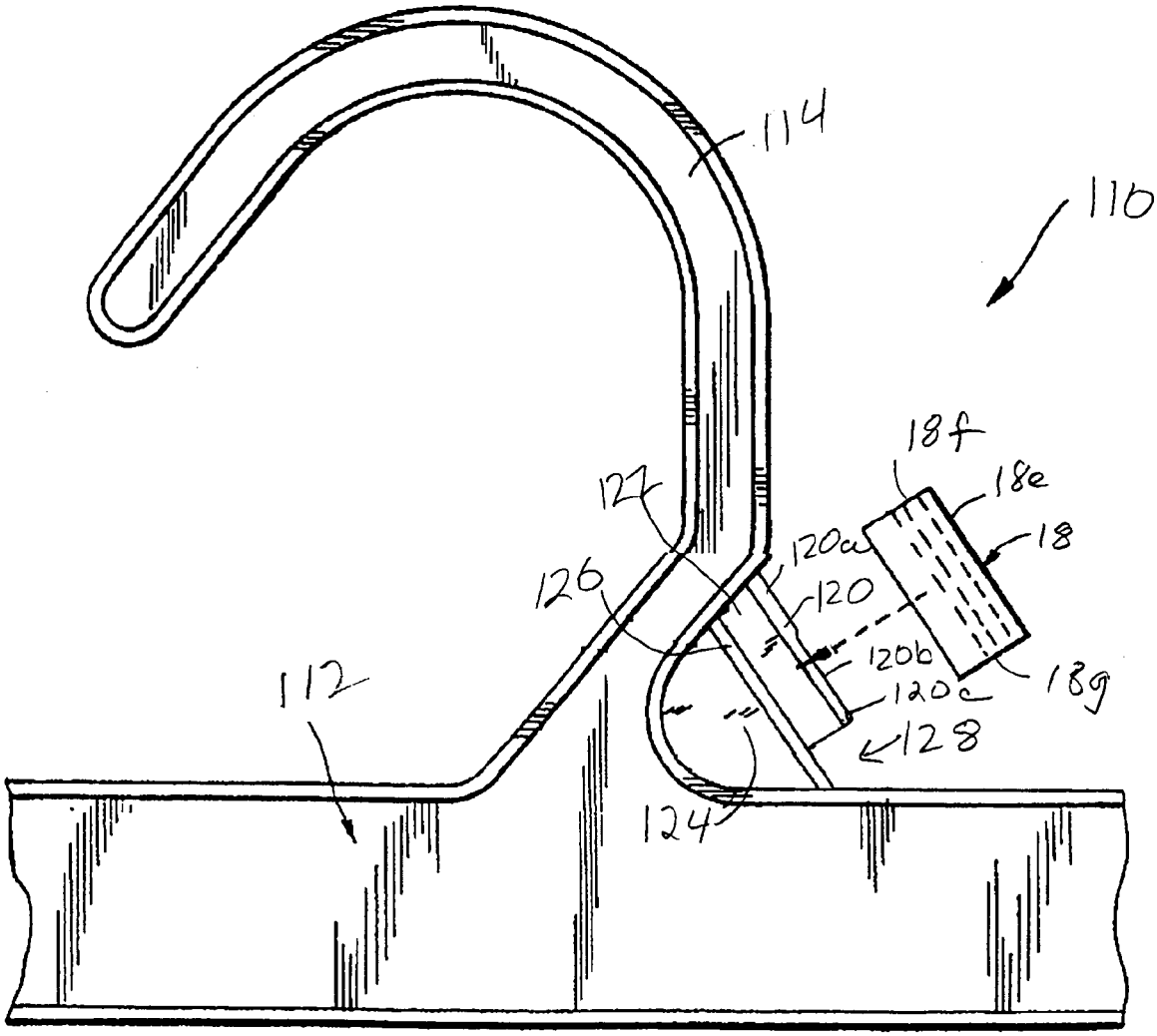
FIG. 6 is a view similar to FIG. 1 illustrating an alternate embodiment.

FIG. 6 shows an alternate embodiment of a hanger 110 which is similar to the hanger 10 with similar reference numerals (increased by 100) referring to similar features. Here, the configuration of the rib 120 is opposite to that of the rib 20 in the hanger 10. The top portion 120*a* of the rib is thick and below it is the middle portion 120*b* with the bevel being provided at the bottom 120*c*. The notch 128 is located between the lower end of the rib 120 and the cross member 112. Hook 114, plateau 124, ramp 126, and valley 122 are substantially identical to their counterparts of FIG. 1. In this embodiment, the indicator 18 is removed by pressing end 18*g* into the notch 128. Similarly, in this embodiment, the indicator 18 may be snapped into place on the web either by moving the indicator as shown in FIG. 1, or by aligning the indicator such that it is generally perpendicular to the web with the closed top 18*e* located away from the rib 120, moving the indicator into the notch 128 so that the end 18*g* abuts the ramp 126 (or plateau 124), and rotating the indicator counterclockwise until the indicator snaps into place.

Figure 7:
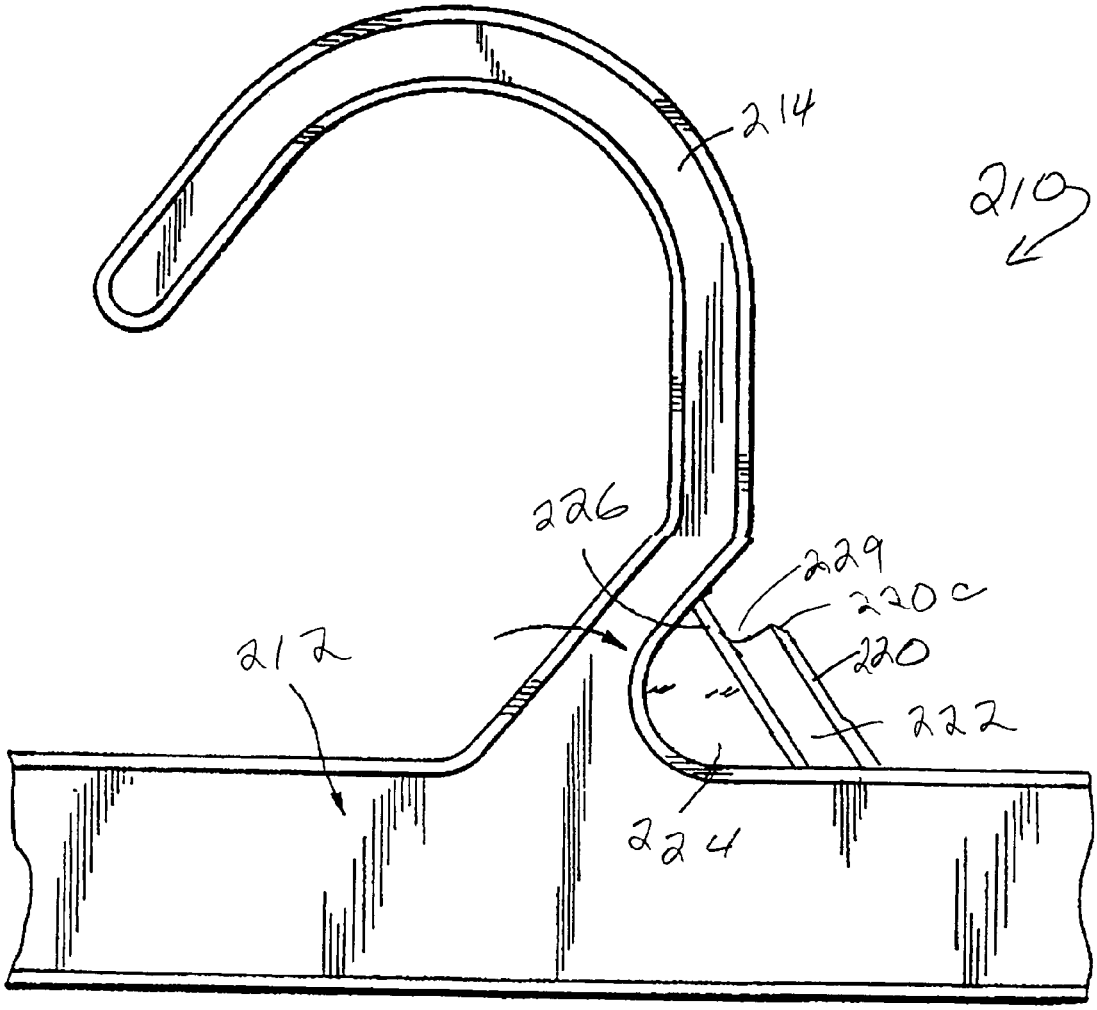
FIG. 7 is a view similar to FIG. 1 illustrating a second alternate embodiment.

FIG. 7 shows an alternate embodiment of a hanger 210 which is similar to the hanger 10 with similar reference numerals (increased by 200) referring to similar features. The difference with this hanger is that the corner of the notch between the valley 222 and the ramp 226 is radiused at 229. This helps scoot the indicator (not shown in this Fig.) outward on removal (see FIG. 3). In addition, the beveled top 220*c* of the rib 220 wraps around into the notch.

There have been described and illustrated herein garment hangers with removable side indicators. While particular embodiments of the invention have been described, it is not intended that the invention be limited thereto, as it is intended that the invention be as broad in scope as the art will allow and that the specification be read likewise. For example, while a hanger has been shown with a horizontal cross member, the cross member could be angled down on either side of the hook as is seen in many garment hangers. It will therefore be appreciated by those skilled in the art that yet other modifications could be made to the provided invention without deviating from its spirit and scope as claimed.

What is claimed is:

1. A garment hanger, comprising:

a cross member;

a hook extending up from said cross member; and a web extending between the hook and the cross member, said web defining an edge, a valley extending from said edge, a ramp extending from said valley, and a plateau extending from said ramp, said edge defining a rib, said rib having a beveled portion, wherein said web defines a notch adjacent to said beveled portion of said rib, said notch extending from said edge to said ramp or to said plateau.

2. The hanger according to claim 1, wherein:

said notch defines a substantially right angle between said ramp and said valley.

3. The hanger according to claim 1, wherein:

said notch is adjacent to said hook.

4. The hanger according to claim 1, wherein:

said notch is adjacent to said cross member.

5. The hanger according to claim 1, further comprising:

a removable indicator having internal means for engaging said rib.

6. The hanger according to claim 1, wherein:

said rib has two ends, said beveled portion being at one end and the other end being thickened with a thinner portion between said ends.

7. The hanger according to claim 5, wherein:

said internal means include a pair of fingers.

8. The hanger according to claim 7, wherein:

said indicator is substantially U-shaped with inwardly turned ends.

9. The hanger according to claim 8, wherein:

said indicator fingers embrace said rib and said inwardly turned ends abut said ramp.

10. The hanger according to claim 1, wherein:

said notch has a radiused corner.

11. The hanger according to claim 1, wherein:

the beveled portion of the rib wraps around into the notch.

12. A method of removing an indicator from a web on a garment hanger having a hook and a cross member with the web extending therebetween, the web defining an edge, a valley extending from the edge, a ramp extending from the valley, and a plateau extending from said ramp, the edge defining a rib, the rib having a beveled portion, the web having a notch which extends from the edge to the ramp or to the valley, the method comprising:

pressing a first end of the indicator into the notch.

13. The method according to claim 12, further comprising:

pulling or rotating a second end of the indicator until said indicator is removed from the web.

14. The method according to claim 13, wherein:

the notch is adjacent the hook.

15. The method according to claim 13, wherein:

the notch is adjacent the cross member.

16. A method of attaching an indicator to a web on a garment hanger having a hook and a cross member with the web extending therebetween, the web defining an edge, a valley extending from the edge, a ramp extending from the valley, and a plateau extending from said ramp, the edge defining a rib, the rib having a beveled portion, the web having a notch which extends from the edge to the ramp or to the valley, the method comprising:

aligning the indicator such that it is generally perpendicular to the web;

moving one end of the indicator into the notch adjacent the ramp or plateau; and rotating the indicator until the indicator snaps into place.

17. A method according to claim 16, wherein:

the notch is adjacent the hook and said rotating comprises rotating the indicator in a clockwise direction.

18. A method according to claim 16, wherein:

the notch is adjacent the cross member and said rotating comprises rotating the indicator in a counterclockwise direction.

19. A method according to claim 16, wherein:

said indicator is substantially U-shaped with a pair of inwardly turned legs, and further includes internal means for engaging the rib, and said rotating comprises causing said inwardly turned legs to engage the beveled portion in order to spread the legs and permit the internal means for engaging the rib to move past the rib and into the valley.

* * * * *